US008561867B2

(12) United States Patent
Kobayashi

(10) Patent No.: US 8,561,867 B2
(45) Date of Patent: Oct. 22, 2013

(54) GAS COMBUSTION TYPE FASTENER DRIVING MACHINE

(75) Inventor: Tsuyoshi Kobayashi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 259 days.

(21) Appl. No.: 13/070,231

(22) Filed: Mar. 23, 2011

(65) Prior Publication Data

US 2011/0240708 A1 Oct. 6, 2011

(30) Foreign Application Priority Data

Apr. 2, 2010 (JP) ..... P2010-086075

(51) Int. Cl.
*B25C 1/04* (2006.01)

(52) U.S. Cl.
USPC ..... 227/2; 227/10; 227/130; 123/46 SC

(58) Field of Classification Search
USPC ..... 227/8, 130, 10, 2, 120; 123/46 SC
See application file for complete search history.

(56) References Cited

U.S. PATENT DOCUMENTS 4,483,474 A * 11/1984 Nikolich ..... 227/8
4,806,832 A * 2/1989 Muller ..... 388/833
5,592,580 A 1/1997 Doherty et al.
6,739,490 B1 5/2004 Shkolnikov et al.
6,796,476 B2 * 9/2004 Birk et al. ..... 227/2
6,886,730 B2 * 5/2005 Fujisawa et al. ..... 227/8
7,021,251 B2 * 4/2006 Ohmori et al. ..... 123/46 R
7,040,261 B2 * 5/2006 Granacher et al. ..... 123/46 SC
7,063,052 B2 * 6/2006 Nishikawa et al. ..... 123/46 SC
7,163,134 B2 * 1/2007 Moeller et al. ..... 227/8
7,275,505 B2 * 10/2007 Moeller et al. ..... 123/46 SC
7,431,185 B2 * 10/2008 Moeller et al. ..... 227/10
7,497,271 B2 * 3/2009 Moeller et al. ..... 173/1
7,598,690 B2 * 10/2009 Yang et al. ..... 318/254.1

FOREIGN PATENT DOCUMENTS

JP 2004-025441 1/2004

* cited by examiner

*Primary Examiner* — Scott A. Smith
(74) *Attorney, Agent, or Firm* — Drinker Biddle & Reath LLP

(57) ABSTRACT

In a gas combustion type fastener driving machine, a fuel gas and air are stirred by a fan within a combustion chamber, a stirred air-fuel gas mixture is burned by an ignition spark, and a striking piston is actuated by a combustion pressure to drive a fastening member. The machine is provided with a fan motor (320) for rotating the fan, and a control circuit board (100) for controlling an action of the fan motor (320). The control circuit board (100) detects an actuation signal for an igniter (310) that generates the ignition spark and controls a rotation speed of the fan motor (320) based on the actuation signal.

4 Claims, 3 Drawing Sheets

GAS COMBUSTION TYPE FASTENER DRIVING MACHINE

BACKGROUND OF THE INVENTION

1. Field of the Invention

The present invention relates to a gas combustion type fastener driving machine, in which a fuel gas and air are stirred by a fan within a combustion chamber, a stirred air-fuel gas mixture is burned by an ignition spark, and a striking piston is actuated by a combustion pressure to drive a fastening member.

2. Related Art

A gas combustion type fastener driving machine is an apparatus in which a fuel gas supplied from a gas supply source and air are stirred to a necessary and sufficient concentration within a combustion chamber by a fan, the stirred air-fuel gas mixture is burned by an ignition spark, a striking piston is actuated by combustion energy, and a fastening member such as a nail is driven into a wood material or the like. The fan is designed to continue to rotate for a certain period of time even after a driving of the fastening member, so as to discharge an exhaust gas from the combustion chamber and cooling the combustion chamber. For example, as is shown in FIG. 6, even after a trigger switch is on and an ignition plug sparks, a fan motor continues to be actuated for a predetermined period of time (for example, 8 seconds) after a fan switch is switched off.

A battery is used as a power source in the gas combustion type fastener driving machine. The battery is most consumed by an actuation of the fan motor in a series of actions of the gas combustion type fastener driving machine. Consequently, a number of fastening members that can be driven per a single charging of the battery (a total available driving number of fastening members) is largely affected by the actuation of the fan motor.

For example, U.S. Pat. No. 5,592,580 describes an energy output control system for a fastener driving tool in which a voltage proportional to a rotation speed of a fan is sampled, so that a supply voltage to a motor is controlled based on the sampled voltage.

When the control system U.S. Pat. No. 5,592,580 is used, a sampling circuit needs to be provided in order to check the rotation speed of the fan. Thus, there is caused a problem that production costs and a surface area of a circuit board need to be increased for the sampling circuit.

SUMMARY OF THE INVENTION

One or more embodiments of the invention provide a gas combustion type fastener driving machine which can further increase a total available driving number of fastening members per a single charging of a battery without providing any special circuit.

In accordance with one or more embodiments of the invention, a gas combustion type fastener driving machine may include a fan motor 320 for rotating the fan, and a control circuit board 100 for controlling an action of the fan motor 320. The control circuit board may be configured to detect an actuation signal for an igniter 310 that generates the ignition spark and to control a rotation speed of the fan motor 320 based on the actuation signal.

In the above structure, the actuation signal may be generated by an operation of a trigger switch 210.

In the above structure, the actuation signal may be generated after a predetermined period of time elapses from a detection of an operation of a fan switch 220.

In the above structure, the fan motor 320 may be controlled to be driven by PAM or PWM.

Other aspects and advantages of the invention will be apparent from the following description and the appended claims.

DETAILED DESCRIPTION OF THE EXEMPLARY EMBODIMENTS

An exemplary embodiment of the invention will be described by reference to the drawings.

Figure 1:
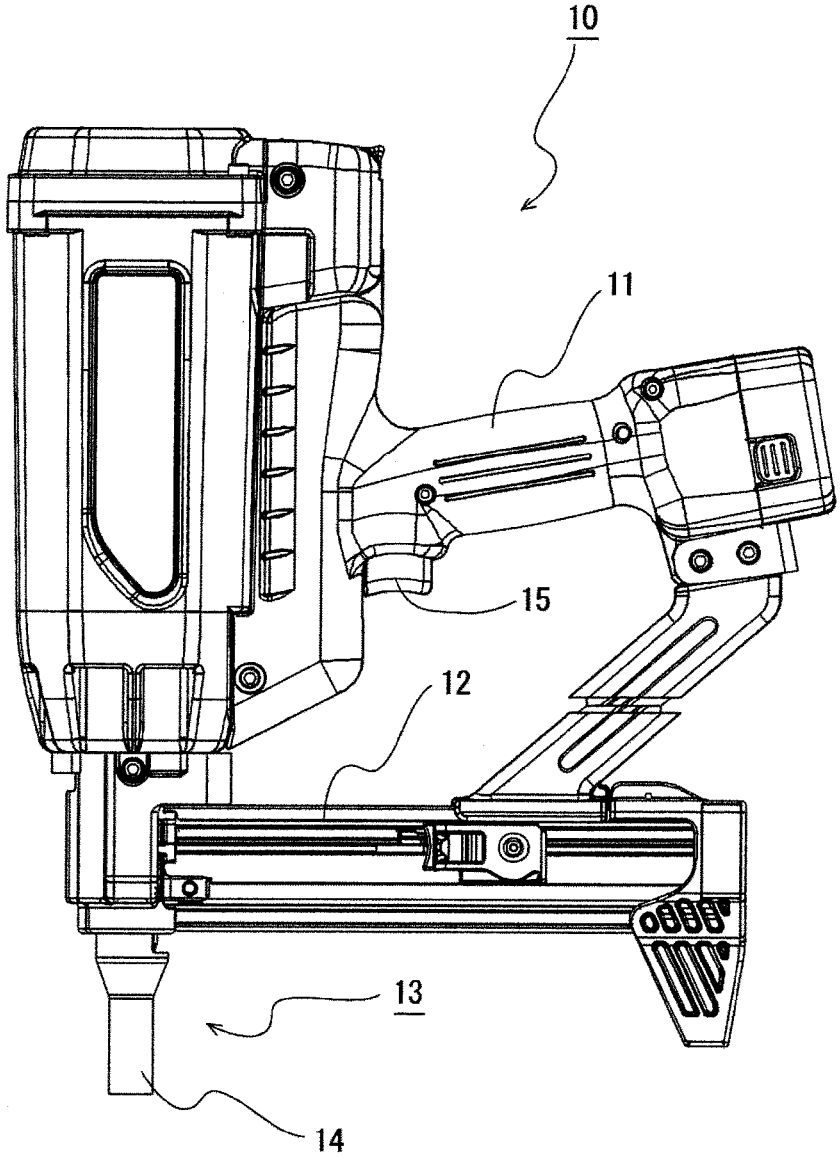
FIG. 1 is an external view of a gas combustion type fastener driving machine according to an exemplary embodiment of the invention.

As is shown in FIG. 1, a grip 11 and a magazine 12 are connected to a tool main body 10 of a gas combustion type fastener driving machine of the exemplary embodiment, and a striking piston-cylinder mechanism is provided in an interior of the tool main body 10. A nose portion 13 for driving out nails is provided to extend downwards from the tool main body 10.

The striking piston-cylinder mechanism is such that a striking piston is slidably accommodated within a striking cylinder and a driver is integrally connected downwards of the striking piston. In addition, a combustion chamber is provided upwards of the striking cylinder.

What is disposed in the combustion chamber are: an injection nozzle for injecting a combustible gas into the combustion chamber; a fan for stirring the combustible gas injected into the combustion chamber and air in the combustion chamber to produce an air-gas mixture of a predetermined air-fuel ratio within the combustion chamber; and an ignition plug 310 for igniting the air-fuel mixture to make it burn. The fan is driven to rotate by a fan motor 320 as a power source.

The fan motor 320 is a DC motor which is driven to rotate by obtaining a direct current driving voltage from a battery provided in an interior of the gas combustion type fastener driving machine.

(Control Circuit Board 100)

A control circuit board 100 is provided in an interior of the grip 11 and controls the driving of the fan motor 320 and the actuation of the ignition plug 310.

Figure 2:
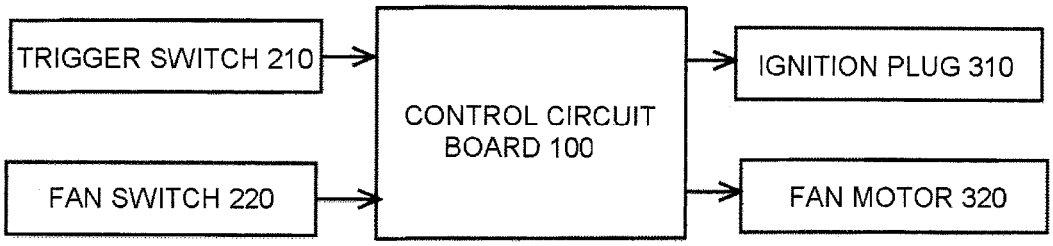
FIG. 2 is a block diagram showing inputs to and outputs from a control circuit board.

Namely, as is shown in FIG. 2, a trigger switch 210 and a fan switch 220 are connected to the control circuit board 100 as input side devices, and the ignition plug 310 and the fan motor 320 are connected to the control circuit board 100 as output side devices. Input devices and output devices that are connected to the control circuit board 100 are not limited thereto, and hence, other devices may be connected to the control circuit board 100.

The trigger switch 210 is a switch provided in the interior of the tool main body 10 and a switch which is on when a trigger 15 is pulled. The control circuit board 100 controls the ignition plug 310 so as to perform an igniting operation when the trigger switch 210 is on.

Figure 4:
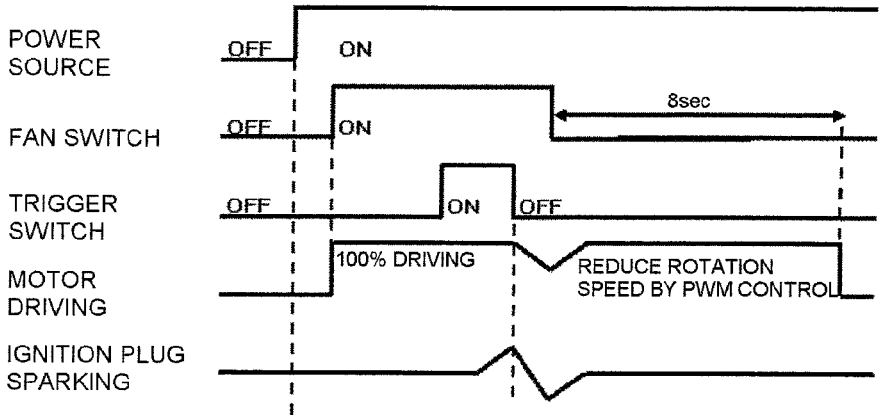
FIG. 4 is a timing chart in relation to the control of the fan motor of the exemplary embodiment.

In addition, the control circuit board 100 includes an inverter circuit and controls the driving of the fan motor 320 based on a PWM (Pulse Width Modulation) via the inverter circuit. Namely, the control circuit board 100 controls the rotation speed of the fan motor 320 by controlling the voltage application time during which voltage is applied to the fan motor 320. Then, the control circuit board 100 controls the fan motor 320 so as to reduce the rotation speed thereof by reducing the voltage application time to the fan motor 320 when the trigger switch 210 is on. Namely, as is shown in FIG. 4, the control circuit board 100 controls the fan motor 320 so as to reduce the rotation speed thereof through the PWM control after the trigger switch 210 is on and the ignition plug 310 sparks.

Additionally, the fan switch 220 is a switch provided upwards of a contact arm 14 and a switch which is on when the contact arm 14 is pressed against a material into which a fastener is to be driven to thereby be moved upwards relative to the tool main body 10. As is shown in FIG. 4, the control circuit board 100 controls the fan motor 320 so as to start rotating when the fan switch 220 is on.

The fan switch 220 is off when the contact arm 14 moves away from the fastener driven material. Then, as is shown in FIG. 4, when the fan switch 220 is off, the control circuit board 100 controls the fan motor 320 so as to stop rotating after a predetermined period of time elapses (for example, after 8 seconds elapses) from the detection of the fan switch 220 being switched off.

(Flow of Nail Driving)

Firstly, in driving a nail, the contact arm 14 is pressed strongly against a fastener driven material so as to move upwards relative to the tool main body 10. By the upward movement of the contact arm 14, the combustion chamber is closed tightly, and a combustible gas is injected into the combustion chamber form the injection nozzle.

In addition, when the contact arm 14 moves upwards, the fan switch 220 is on, and the fan motor 320 in the combustion chamber 320 is driven to rotate the fan, whereby the combustible gas and air is stirred to be mixed with each other.

Thereafter, when the trigger 15 is pulled, the trigger switch 210 is on, and therefore, the air-gas mixture in the combustion chamber is ignited by the ignition plug 310 to burn explosively. The explosive burning of the air-gas mixture actuates the striking piston, and a nail supplied into the nose portion 13 is driven out.

When the driving of the nail is completed, the striking piston is restored. Further, when the contact arm 14 is caused to move away from the fastener driven material, the combustion chamber is opened, whereby fresh outside air is introduced into the combustion chamber while exhaust gases are expelled from the combustion chamber.

In addition, although the fan switch 220 is switched off as a result of the contact arm 14 moving away from the fastener driven material, the fan motor 320 continues to be driven for 8 seconds after an OFF signal signaling the switching off of the fan switch 220 is produced. Thus, the exhaust gases continue to be expelled from the combustion chamber and the combustion chamber continues to be cooled by the fan motor 320 being so driven.

(Flow of Control of Fan Motor 320)

A flow of control of the fan motor 320 is as follows.

Figure 3:
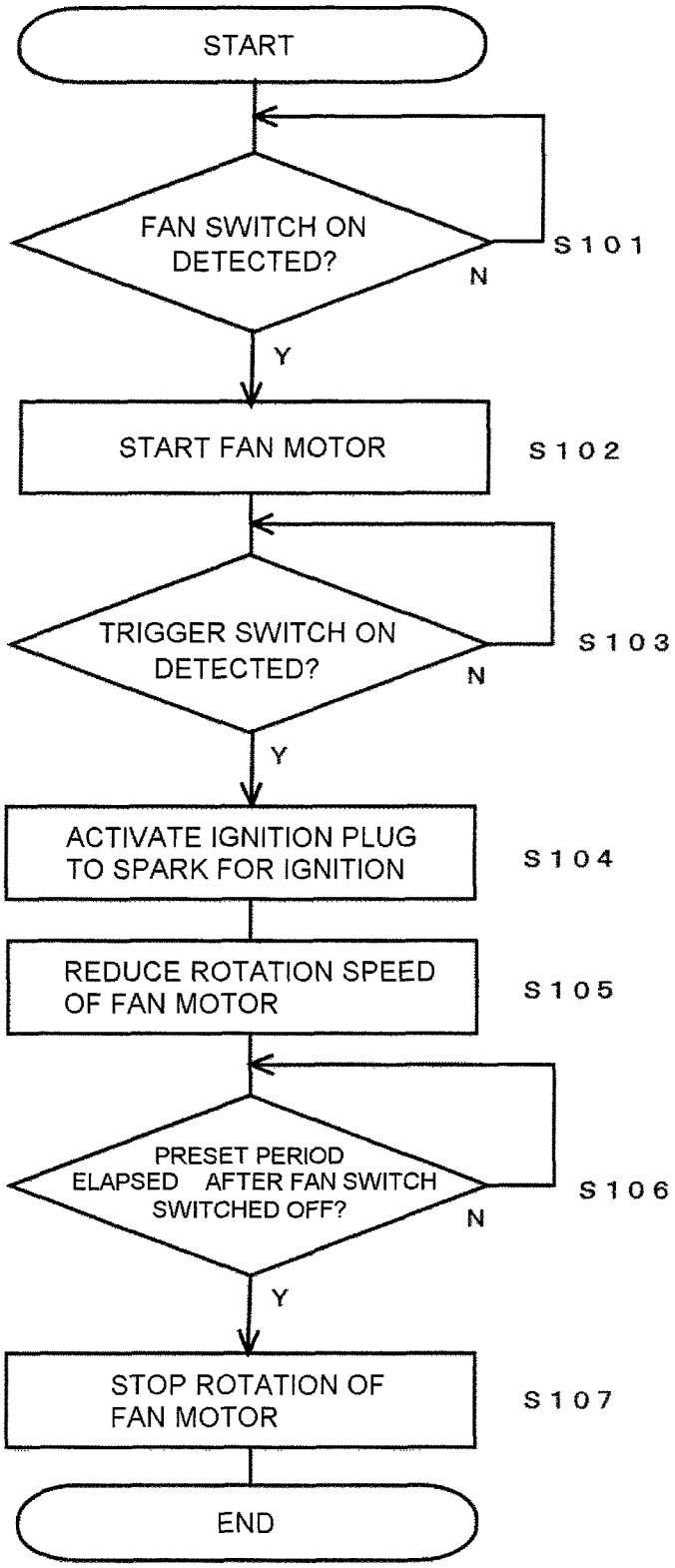
FIG. 3 is a flowchart in relation to a control of a fan motor.

Namely, as is shown in step S101 in FIG. 3, firstly, when the contact arm 14 is pressed against the fastener driven material, the fan switch 220 is on. When the control circuit board 100 detects the fan switch 220 being switched on, the flow proceeds to step S102.

Next, in step S102, the control circuit board 100 causes the fan motor 320 to start rotating so as to start the stirring of combustible gas and air in the combustion chamber. As this occurs, the control circuit board 100 controls the fan motor 320 to make full use of its characteristics so that the rotation speed of the fan motor 320 reaches a set rotation speed (for example, 8000 rpm) as soon as possible. Then, the flow proceeds to step S103.

Next, in step S103, when the trigger 15 is pulled, the trigger switch 210 is on. When the control circuit board 100 detects the trigger switch 210 being switched on, the flow proceeds to step S104.

Next, in step S104, the control circuit board 100 controls the ignition plug 310 to spark so as to ignite the air-gas mixture in the combustion chamber so that the air-gas mixture burns therein. By the burning of the air-gas mixture, the striking piston in the striking cylinder slides so as to drive the fastening member into the fastener driven material. Then, the flow proceeds to step S105.

Next, in step S105, the control circuit board 100 controls the fan motor 320 so as to reduce the rotation speed thereof. Namely, after the air-gas mixture is ignited, exhaust gases can sufficiently be expelled from the combustion chamber and the combustion chamber can sufficiently be cooled without controlling the fan motor 320 so as to rotate at a maximum speed thereof. Therefore, the control circuit board 100 controls the fan motor 320 so as to reduce the rotation speed thereof (for example, down to 4000 rpm) by reducing the voltage application time to the fan motor 320. Then, the flow proceeds to step S106.

Next, in step S106, the control circuit board 100 waits until a predetermined period of time (for example, 8 seconds) elapses after detecting that the fan switch 220 is switched off. Then, the flow proceeds to step S107.

Next, in step S107, the predetermined period of time has elapsed after detecting that the fan switch 220 is switched off, and therefore, the control circuit board 100 stops the rotation of the fan motor 320. Then, the control of the fan motor 320 is completed.

Thus, as has been described heretofore, in the exemplary embodiment, since the control circuit board 100 controls the rotation speed of the fan motor 320 based on the actuation signal signaling the actuation of the trigger switch 210, not only can the characteristics of the fan motor 320 be made full use of so as to cause the fan motor 320 to reach the set rotation speed as soon as possible before ignition, but also the driving of the fan motor 320 can be limited since after ignition, the fan motor 320 only has to be rotating at a rotation speed necessary for expelling exhaust gases from the combustion chamber and cooling the combustion chamber, whereby the wasteful consumption of the battery can be suppressed so as to increase the total number of actually driven fastening members per a single charging of the battery.

Moreover, since the driving control of the fan motor 320 in the way described above is performed based on the actuation signal signaling the actuation of the trigger switch 210, the consumption of the battery can be suppressed without providing a special circuit such as a sampling circuit.

In the exemplary embodiment, while the control circuit board 100 is described as controlling the fan motor 320 based on the PWM system, the invention is not limited thereto, and hence, the control circuit board 100 may control the fan motor 320 based on a PAM (Pulse Amplitude Modulation) system. Namely, the rotation speed of the fan motor 320 may be controlled by controlling the value of a voltage applied to the fan motor 320 by the inverter circuit that the control circuit board 100 includes. As this occurs, the control circuit board

100 controls the fan motor 320 so as to reduce the rotation speed thereof by reducing the value of voltage applied to the fan motor 320 when the trigger switch 210 is switched on. The PAM system and the PWM system may both be adopted in parallel in the control circuit board 100. Even in the case of such a configuration being adopted, there would be caused no problem, provided that the rotation speed of the fan motor 320 is controlled by controlling the value of voltage applied to the fan motor 320 or the voltage application time during which voltage is applied to the fan motor 320.

In addition, in the exemplary embodiment, while the control circuit board 100 is described as switching the control of the fan motor 320 through the detection of the trigger switch 210 being switched on by the control circuit board 100, the invention is not limited thereto, and therefore, the control circuit board 100 may be made to switch the control of the fan motor 320 through the detection of the trigger switch 210 being switched off by the control circuit board 100.

Figure 5:
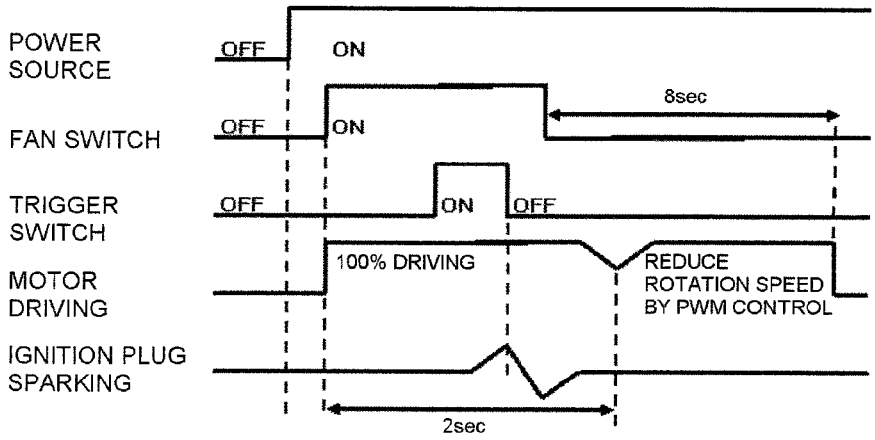
FIG. 5 is a timing chart in relation to a control of a modified example.
Figure 6:
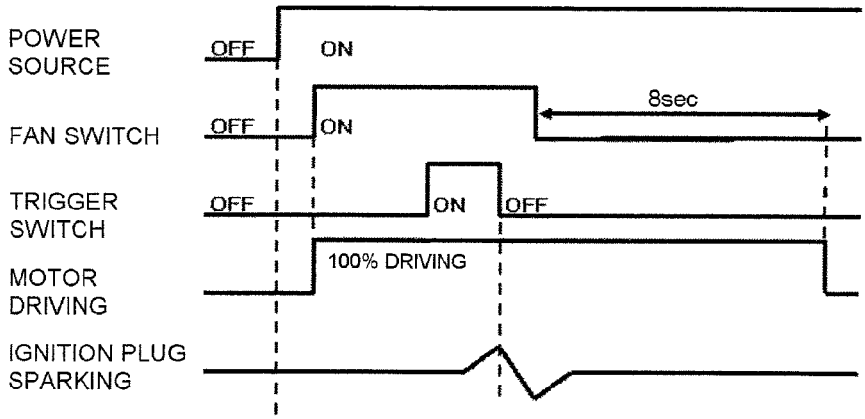
FIG. 6 is a timing chart in relation to a control of a conventional example.

Alternatively, since it is estimated that the actual working time from the actuation of the contact arm 14 to the actuation of the trigger 15 is short (0.3 to 2 seconds), a configuration may be adopted in which as is shown in FIG. 5, the control of the fan motor 320 is switched so as to reduce the rotation speed of the fan motor 320 when a predetermined period of time (for example, 2 seconds) elapses after the fan switch 220, which is actuated by the contact arm 14, is switched on. In this case, too, the system based on which the fan motor 320 is controlled by the control circuit board 100 is not limited to the PWM system, and hence, the PAM system may be adopted, or both the PAM system and the PWM system may be adopted in parallel.

In addition, the control of the fan motor 320 may be switched by making use of other switches than the switches which work in relation to the trigger 15 and the contact arm 14.

While description has been made in connection with a specific exemplary embodiment and a specific modified example thereof, it will be obvious to those skilled in the art that various changes and modifications may be made therein without departing from the present invention. It is aimed, therefore, to cover in the appended claims all such changes and modifications falling within the true spirit and scope of the present invention.

DESCRIPTION OF REFERENCE NUMERALS AND SIGNS

10 tool main body
11 grip
12 magazine
13 nose portion
14 contact arm
15 trigger
100 control circuit board
210 trigger switch
220 fan switch
310 ignition plug
320 fan motor

What is claimed is:

1. A gas combustion type fastener driving machine in which a fuel gas and air are stirred by a fan at an air-fuel gas mixture stirring speed within a combustion chamber, a stirred air-fuel gas mixture is burned by an ignition spark, and a striking piston is actuated by a combustion pressure to drive a fastening member, the machine comprising:

a fan motor for rotating the fan; and a control circuit board for controlling an action of the fan motor, wherein the control circuit board is adapted to detect an actuation signal for an igniter that generates the ignition spark and to reduce a rotation speed of the fan motor to an exhaust gas expulsion speed based on the actuation signal.

2. The machine according to claim 1, wherein the actuation signal is generated by an operation of a trigger switch.

3. The machine according to claim 1, wherein the control circuit board controls the fan motor so as to start rotating at the air-fuel gas mixture stirring speed when a fan switch is switched on, the actuation signal is generated after a predetermined period of time elapses from a time when the fan switch is switched on, and the control circuit board reduces the rotation speed of the fan motor at the exhaust gas expulsion speed based on the generated actuation signal.

4. The machine according to claim 1, wherein the fan motor is controlled to be driven by PAM or PWM.

* * * * *